US011125001B2

(12) United States Patent
Homner

(10) Patent No.: US 11,125,001 B2
(45) Date of Patent: Sep. 21, 2021

(54) HINGE COMPRISING A BIASABLE FLAT SPIRAL SPRING

(71) Applicant: S-FASTENERS GMBH, Althengstett (DE)

(72) Inventor: Bernhard Homner, Calw-Stammheim (DE)

(73) Assignee: S-FASTENERS GMBH, Althengstett (DE)

( * ) Notice: Subject to any disclaimer, the term of this patent is extended or adjusted under 35 U.S.C. 154(b) by 0 days.

(21) Appl. No.: 16/754,132

(22) PCT Filed: Oct. 5, 2018

(86) PCT No.: PCT/EP2018/077184
§ 371 (c)(1),
(2) Date: Apr. 6, 2020

(87) PCT Pub. No.: WO2019/068892
PCT Pub. Date: Apr. 11, 2019

(65) Prior Publication Data

US 2020/0332579 A1 Oct. 22, 2020

(30) Foreign Application Priority Data

Oct. 6, 2017 (DE) ..... 202017106061.6

(51) Int. Cl.
*E05F 1/12* (2006.01)
*E05D 11/00* (2006.01)

(52) U.S. Cl.
CPC ..... *E05F 1/1215* (2013.01); *E05D 11/0054* (2013.01); *E05F 1/1207* (2013.01);
(Continued)

(58) Field of Classification Search
CPC ... E05F 1/1207; E05F 1/1215; E05D 11/0054
See application file for complete search history.

(56) References Cited

U.S. PATENT DOCUMENTS 90,769 A * 6/1869 Middaugh ..... E05F 1/1215 16/297
98,709 A * 1/1870 Renshaw ..... E05F 1/1215 16/300

(Continued)

FOREIGN PATENT DOCUMENTS

CN 245625616 Y 4/2001
CN 204357250 U 5/2015

(Continued)

OTHER PUBLICATIONS

International Search Report and Written Opinion dated Dec. 19, 2018.

(Continued)

*Primary Examiner* — Jeffrey O'Brien
(74) *Attorney, Agent, or Firm* — Womble Bond Dickinson (US) LLP; Joseph Bach, Esq.

(57) ABSTRACT

The invention relates to a hinge (10) comprising a pivotable hinge part (12), a fixed hinge part (14) and a biasable spring element, wherein the pivotable hinge part (12) is pivotably mounted on the fixed hinge part (14) about a pivot axis (S) via a bearing (16), and wherein the biasable spring element is arranged on the bearing (16). The invention is characterized in that the spring element is designed as a flat spiral spring (18).

19 Claims, 5 Drawing Sheets

(52) U.S. Cl.
CPC ..... *E05Y 2201/492* (2013.01); *E05Y 2600/12* (2013.01); *E05Y 2900/502* (2013.01)

(56) References Cited

U.S. PATENT DOCUMENTS 155,129 A * 9/1874 Warren ..... E05F 1/1215 16/280
162,735 A * 5/1875 Annin ..... E05F 1/1215 16/300
172,935 A * 2/1876 Reynolds ..... E05F 1/1215 16/300
1,172,267 A * 2/1916 Eisner ..... E05F 1/1215 16/299
2,308,759 A * 1/1943 Joachim ..... E05F 1/1207 16/295
2,580,593 A * 1/1952 Putnam ..... E05F 1/1207 16/85
2,675,578 A * 4/1954 Atwood ..... E05F 1/1207 16/85
2,677,146 A * 5/1954 Vigmostad ..... E05F 1/1207 16/294
2,997,733 A * 8/1961 Ragsdale ..... E05F 1/1207 16/333
4,377,019 A * 3/1983 Takahashi ..... E05F 1/1207 16/307
4,428,095 A * 1/1984 Takahashi ..... E05F 1/1207 16/297
4,550,470 A * 11/1985 Omata ..... E05F 3/14 16/85
5,050,270 A 9/1991 Burgei et al.
5,235,725 A * 8/1993 Rees ..... E05F 1/1207 16/298
5,390,904 A * 2/1995 Rivard ..... E05F 1/1207 16/289
5,483,849 A * 1/1996 Orii ..... A62B 35/0093 188/184
5,673,459 A * 10/1997 Baghdasarian ..... B64G 1/22 16/235
6,181,094 B1 * 1/2001 Menke ..... E05F 1/1207 318/434
8,615,847 B2 * 12/2013 Krajenke ..... E05F 1/1284 16/306
8,955,805 B2 * 2/2015 Savian ..... B60Q 3/43 244/118.5
8,997,313 B1 * 4/2015 Krajenke ..... E05F 1/1207 16/308
9,174,734 B2 * 11/2015 Savian ..... B60Q 3/43
9,279,279 B1 * 3/2016 Kim ..... B60J 5/101
9,366,068 B2 * 6/2016 Krajenke ..... E05F 1/1276
9,789,963 B2 * 10/2017 Savian ..... B64D 11/0015
10,000,286 B2 * 6/2018 Savian ..... B64D 11/0015
10,029,794 B2 * 7/2018 Savian ..... B60Q 3/43
10,112,717 B2 * 10/2018 Savian ..... B64D 11/0015
10,336,454 B2 * 7/2019 Savian ..... B60Q 3/43
10,760,315 B2 * 9/2020 Chadwell ..... B64D 11/003
2004/0135030 A1 * 7/2004 Lau ..... B64D 11/003 244/118.1
2005/0064174 A1 * 3/2005 Gideon ..... B29C 33/0072 428/317.9
2006/0132007 A1 * 6/2006 Beckley ..... B64D 11/003 312/325
2006/0151668 A1 * 7/2006 Scown ..... B64D 11/003 244/118.1
2010/0127443 A1 * 5/2010 Kuroda ..... B60N 2/2356 267/156
2014/0283336 A1 * 9/2014 Cloud ..... B64D 11/003 16/72

FOREIGN PATENT DOCUMENTS

CN 105298273 A 2/2016
CN 204357250 U 5/2017
EP 0894933 A2 2/1999
EP 2405090 A2 1/2012
GB 362528 A 12/1931
GB 362528 A 12/1931
JP 63308174 A 12/1988
JP S63308174 A 12/1988

OTHER PUBLICATIONS

Transmittal of International Preliminary Report on Patentability or PCT/EP2018/077184, filed Oct. 5, 2018, dated Apr. 8, 2020, 8 pages.
First Office Action from related Chinese Patent Application No. 201880065341.3 dated May 19, 2021 (12 pages including translation).

* cited by examiner

HINGE COMPRISING A BIASABLE FLAT SPIRAL SPRING

This application is the national phase of International Application No. PCT/EP2018/077184, filed on Oct. 5, 2018, which claims priority to and the benefit of German Patent Application No. 20 2017106061.6, filed on Oct. 6, 2017, the disclosures of which are hereby incorporated by reference in their entireties.

The invention relates to a hinge comprising a biasable flat spiral spring of the type specified in the preamble of claim 1.

The spring tension of a hinge of this type determines the spring force-induced automatic opening of a closure flap. Conventional airplane luggage compartments are usually equipped with this type of spring in order to move the closure flap automatically from its closed position to a completely opened position.

Luggage compartments are often equipped with gas springs to facilitate opening the flaps and to retain the flaps in the open position. The disadvantage of gas springs is their sensitivity to low temperatures, which may make it difficult to open storage compartments in an airplane that has been cooled down very much, for example. Moreover, because the springs of the hinge are located inside the luggage compartment, they thus diminish the available storage space and can easily be damaged.

EP 0 894 933 B1 describes a hinge comprising a pivotable hinge part and a fixed hinge part with a common hollow cylinder-like hinge axle which is firmly connected to the pivotable hinge part and is rotatably mounted in an axle bearing. The axle bearing body is rigidly connected to the fixed hinge part. A torsion spiral spring, both ends of which are fixed, is arranged in the hinge axle. The tension of the spring can be set by adjusting one of its two fixed ends. The loaded spring acts to open the flap, and a damping device ensures a decelerated opening action of the flap.

Furthermore, EP 2 405 090 B1 discloses an arrangement which makes it easy to set the tension of a torsion spiral spring of a hinge of this type without having to reinstall the spring in the hinge.

A well-known problem of airplane luggage compartments is that the hinges on one or either side of each compartment take up some of the available load volume of the luggage compartment and thus reduce the loadable storage space. The luggage loaded into them may in turn damage the hinges, especially the springs. Fitted hinge covers can be used to protect the hinges; however, these also take up space and complicate assembly and maintenance of the hinge. The configuration and dimensions of generic hinges make it impossible to integrate them into the narrow vertical side walls between the luggage storage boxes.

It is the object of the invention to further develop a hinge of the type specified in the preamble of claim 1 in such a way that the hinge is of a space-saving design.

This object is accomplished by the characteristic features of claim 1 in conjunction with the features of its preamble.

The dependent claims relate to an advantageous embodiment of the invention.

In manner known per se, a hinge comprises a fixed hinge part and a pivotable hinge part that is mounted on the fixed hinge part so as to be rotatable about a pivot axis. The axle bearing is rigidly connected to the fixed hinge part. Around the pivot axis, a tensioned spiral spring is arranged which drives the pivotable hinge part. One end of the spiral spring is firmly connected to the axle bearing and the other end is secured in the axle. The tension of the spiral spring can be adjusted by means of a worm gear.

According to the invention, a biasable flat spiral spring, arranged on a bearing formed on the fixed hinge part, is to serve as a drive for the pivotable hinge part. The flat spiral spring is wound as an Archimedean spiral. Starting from the radially inner end of its coil, the spiral turns of the spring extend in one plane. The radial size of the spring changes with the number of turns. Flat spiral springs are wound from strip or flat material. In an advantageous manner, this flat spiral spring thus provides for a very narrow embodiment of the hinge, thus making it possible to integrate the hinge into the narrow vertical side wall between two luggage storage boxes.

The flat spiral spring and the pivot axle of the pivotable hinge part are coaxially mounted on the bearing, with the pivot axle defining the opening movement of the flap and the flat spiral spring serving as a drive for the opening movement.

Preferably, the outer end of the flat spiral spring is designed such that it can be connected to the pivotable hinge part. The flat spiral spring can thus be firmly fixed at its outer end.

In an advantageous embodiment of the invention, the portion of the pivotable hinge part located on the bearing of the fixed hinge part is designed as a plain bearing. It is possible to design the pivotable hinge part as a hinge leaf having a hinge arm arranged thereon, which plain bearing is formed on the end of the hinge arm remote from the hinge leaf. The advantages of a plain bearing are its low wear and the small radial installation space it requires. Plain bearings are easy to fit, require little maintenance and are insensitive to impact loads.

It is possible to arrange a damping element on the hinge axle to ensure controlled pivoting of the pivotable hinge part. For safety reasons, the flap should pivot upward in a smooth and not too fast movement. Preferably, the damping element is arranged on the pivotable hinge part in a positive-locking manner and is adapted to rotate with the latter. Advantageously, the damping element is mounted in the pivotable hinge part in a space-saving manner, thus ensuring a narrow design of the hinge.

According to another embodiment of the invention, an adjustable torque adjustment unit is operatively connected to the radially inner end of the flat spiral spring. The torque adjustment unit is designed in such a way that it is mounted positively on the bearing in a way that will allow the radially inner end of the flat spiral spring to be connected to the torque adjustment unit. For example, the flat spiral spring can be secured in a groove of the torque adjustment unit. Preferably, an adjusting screw is located in a portion of the torque adjustment unit that is designed as a gear wheel. The adjusting screw, which is located on the fixed part of the hinge, has its shaft meshing with the teeth of the torque adjustment unit. A rotary movement of the adjusting screw will cause the torque adjustment unit to rotate and thus result in the tensioning of the flat spiral spring. The adjusting screw thus serves to maintain the pretension setting.

Preferably, a stop for the pivotable hinge part is provided on the fixed hinge part. It is also possible for the stop to comprise a screw and for the impact of the pivotable hinge part to be damped by means of a spring arranged on the screw. The screw can be used for a fine adjustment of the open position of the hinge.

According to a preferred embodiment of the invention, the fixed hinge leaf is designed as a housing within which the hinge is located. This advantageously protects the mechanical components of the hinge from dirt and damage. It is possible to make the housing of plastic. This will result in a low weight and a robust design. Plastic parts can be manufactured to have a high degree of functionality. For example, the housing can be designed with a cover adapted to be form-fitted, friction-locked or material-locked to the housing.

Preferably, all the individual components of the overall hinge mechanism are accommodated within, and held together by, the housing. For example, the housing may have recesses, walls and/or supports that hold together, guide and/or secure the components.

Additional advantages and possible applications of the present invention may be gathered from the description which follows, in which reference is made to the embodiments illustrated in the drawings.

In the drawings:

FIG. 1 to FIG. 5 are various schematic views of a hinge designated by reference numeral 10.

Figure 1:
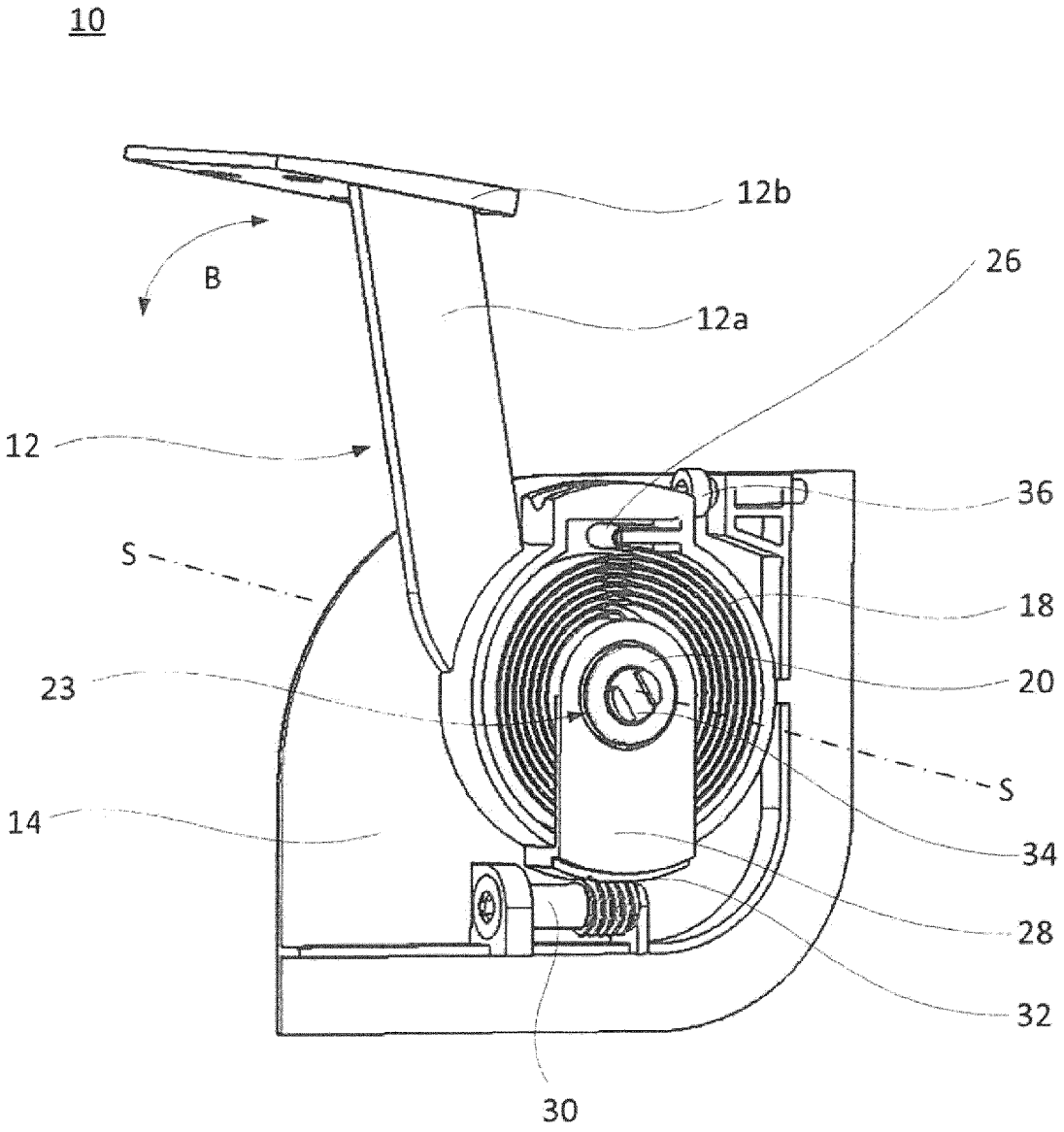
FIG. 1 is a top view of the hinge according to the invention, in an open position thereof.

According to the embodiment illustrated in FIG. 1, hinge 10 comprises a pivotable hinge part 12 and a fixed hinge part 14, which fixed hinge part 14 is formed by a bearing 16 on which the pivotable hinge part 12 is rotatably mounted and on which a flat spiral spring 18 is arranged. The flat spiral spring 18 and the pivotable hinge part 12 are arranged coaxially on the bearing 16.

Figure 2:
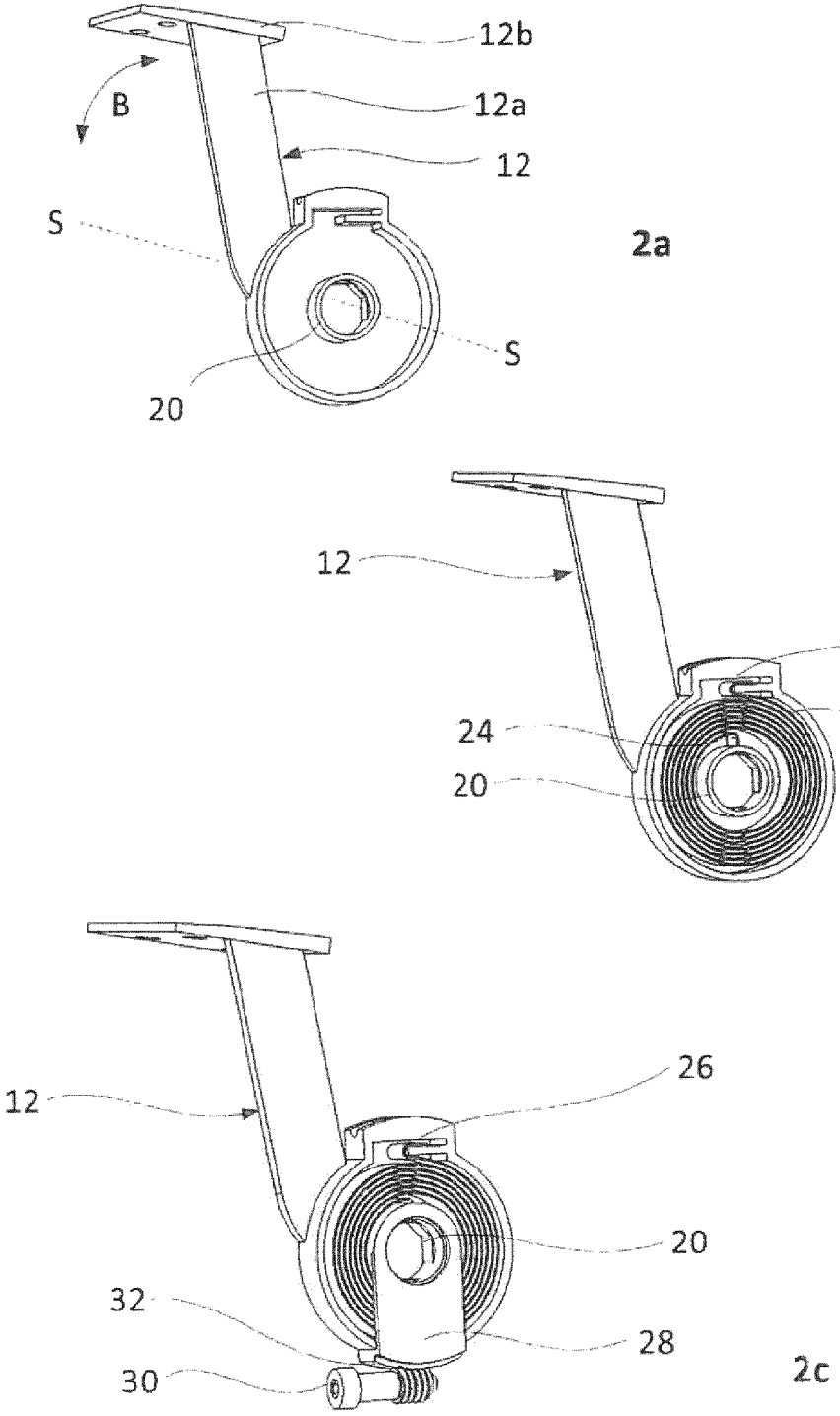
FIG. 2 is a detailed view of the pivotable hinge part, with the flat spiral spring arranged in it and the torque adjustment unit arranged on it.

The embodiment of FIG. 2 shows the pivotable hinge part 12 which has a hinge arm 12*a* and a hinge leaf 12*b*. At its end remote from the hinge leaf 12*b*, the hinge arm 12*a* is formed into a bearing bushing 20, which connects positively with a bearing journal 22 formed on the bearing 16, thus forming a plain bearing 23. The flat spiral spring 18 arranged radially around the bearing 16 constitutes the drive for the pivotable part 12 of the hinge, with the pivot axis S defining the movement B of the hinge.

Figure 3:
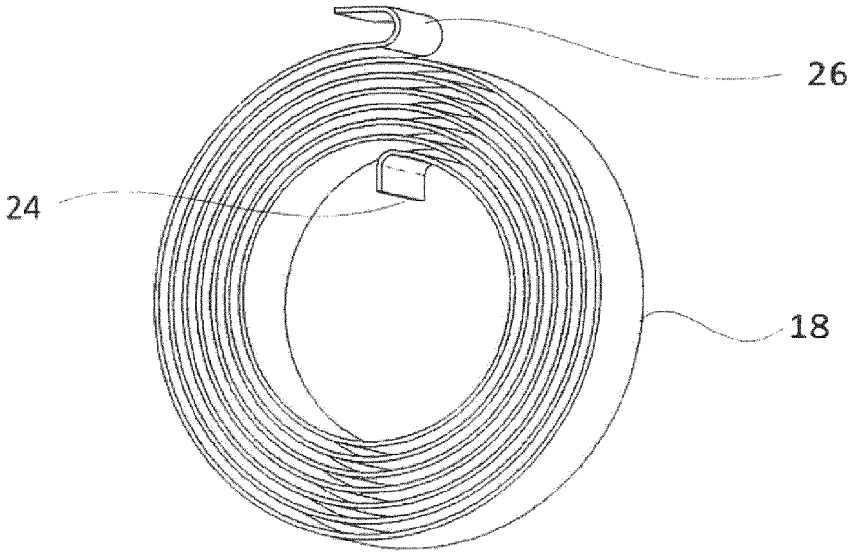
FIG. 3 is a view of a flat spiral spring.

As shown in FIG. 3, starting from the radially inner end 24 of the spring, the flat spiral spring 18 is wound as an Archimedean spiral, and its turns run spirally in one plane. The turns are formed from strip or flat material, thus making the flat spiral spring 18 very narrow as seen perpendicular to the plane of its turns. The radially outer end 26 and the radially inner end 24 of the flat spiral spring 18 are adapted to be anchored in place.

As illustrated in the embodiments of FIG. 1 and FIG. 2, a torque adjustment unit 28 is arranged on the flat spiral spring 18, and the radially inner end 24 of the flat spiral spring 18 is connected to the torque adjustment unit 28. In this embodiment, the flat spiral spring 18 is anchored in a groove of the torque adjustment unit 28. The torque adjustment unit 28 allows the flat spiral spring 18 to be pretensioned to the required torque. The pretension of the flat spiral spring 18 can be varied by means of an adjusting screw 30 located on the fixed hinge part 14, with the screw shaft meshing with a toothed portion 32 of the torque adjustment unit 28. Varying the adjusting screw 30 results in a corresponding rotation of the torque adjustment unit 28, which in turn pretensions the flat spiral spring 18 that is firmly anchored at both its ends 24, 26. The pretension set in this way is maintained by means of the adjusting screw 30. A damping element 34 is arranged on the pivotable hinge part 12 and ensures a controlled smooth upward pivoting movement of the pivotable hinge part 12 and the flap (not shown). In this embodiment, the damping element 34 is positively connected to the pivotable hinge part 12, with the fixed end of the damping element being firmly secured to the cover 42.

In the embodiment illustrated in FIG. 1, a stop 36 with a stop screw 38 for the pivotable hinge part 12 is provided on the fixed hinge part 14. In the completely open position of the flap, the pivotable part makes contact with a stop screw 38 disposed on the fixed hinge part 14. The stop screw 38 can be used for a fine adjustment of the open position of the hinge 10. It is possible to provide a spring on the stop screw 38 in order to dampen the impact.

Figure 4:
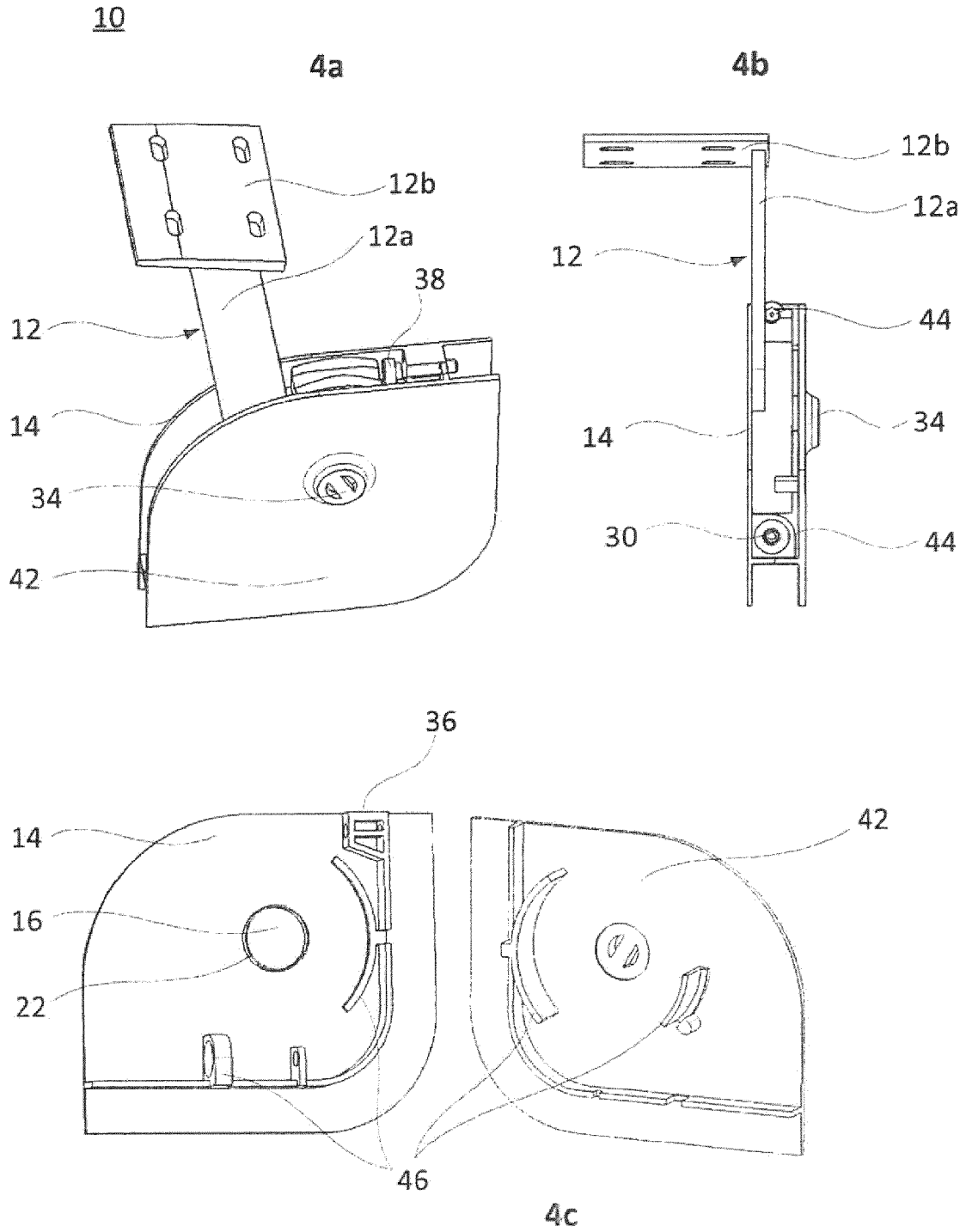
FIG. 4 are views of the housing in its closed and open states, resp.

In the embodiment of the invention shown in FIG. 4, the fixed hinge part 14 is designed as a housing 40. The frontal top view of the housing 40 shows the vertically very narrow design of hinge 10, which is made possible by the flat spiral spring 18. In the present embodiment, the housing 40 comes with a cover 42. It is possible to make the housing 40 of plastic, and to connect the cover 42 to the housing 40 in a positive, force-locking or material-locking manner. The individual components of the hinge 10 are all accommodated within the housing 40. The housing 40 holds the individual parts of the overall mechanism of the hinge 10 together and secures the individual components in place by means of projections 46. The housing 40 advantageously protects the mechanism from damage. The stop screw 38 screwed through the housing 40 and the adjusting screw 30 of the torque adjustment unit 28 are easily accessible from the outside through openings 44 in the housing 40.

Figure 5:
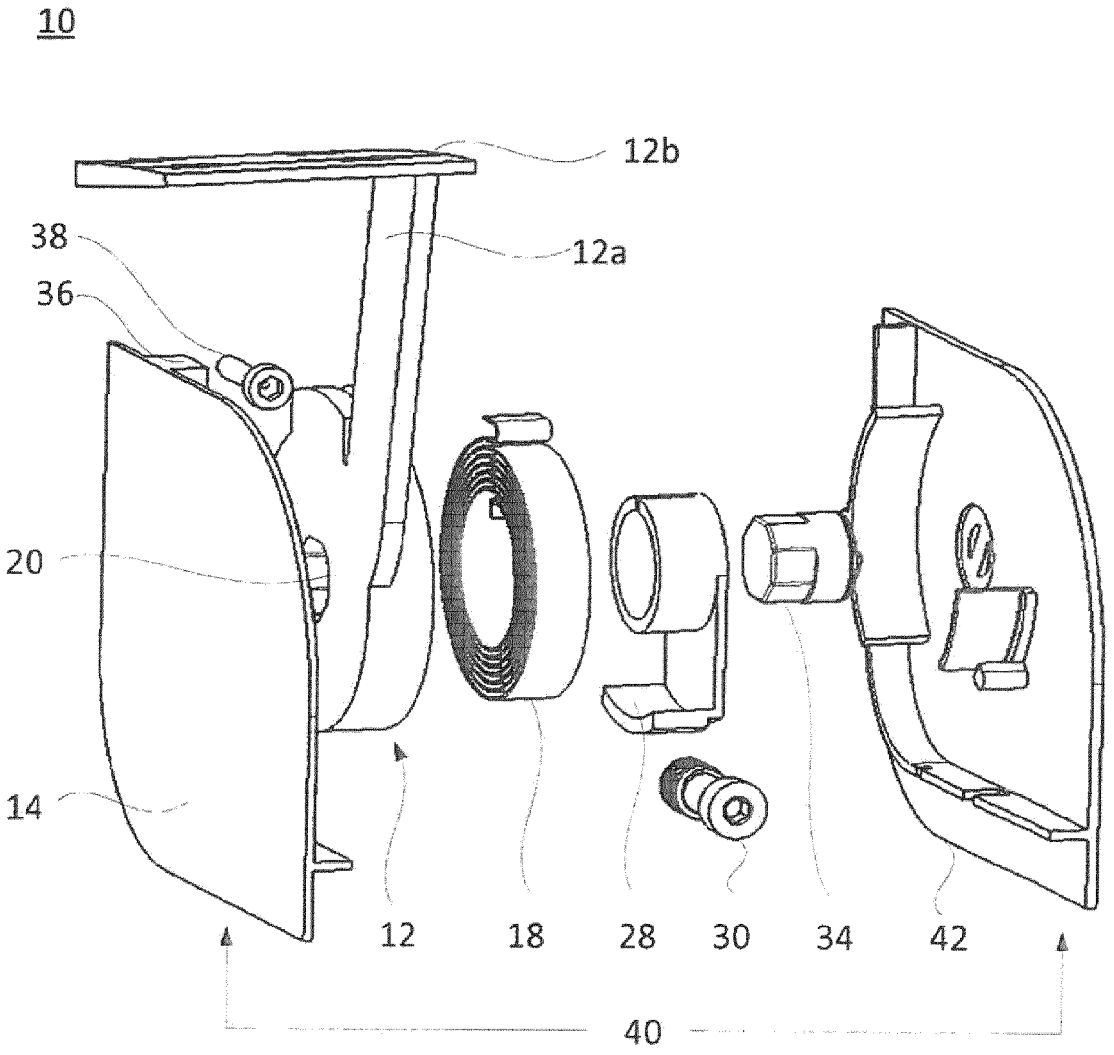
FIG. 5 is an exploded view illustrating the individual components of the hinge.

FIG. 5 is an exploded view of the hinge 10 which in particular illustrates the way the individual parts of the assembly are arranged in housing 40 and how they are secured by housing 40.

LIST OF REFERENCE SIGNS

10 hinge
12 pivotable hinge part
12*a* hinge arm
12*b* hinge leaf
14 fixed hinge part
16 bearing
18 flat spiral spring
20 bearing bushing
22 bearing journal
23 plain bearing
24 inner end of the spring
26 outer end of the spring
28 torque adjustment unit
30 adjusting screw
32 toothed portion of torque adjustment unit
34 damping element
36 stop
38 stop screw
40 housing
42 cover
44 openings
46 projections
B pivot movement
S pivot axis

The invention claimed is:

1. A hinge (10) comprising a pivotable hinge part (12), a fixed hinge part (14) and a biasable spring element (18)

which is a flat spiral spring wound to form an Archimedean spiral, wherein the pivotable hinge part (12) is mounted via a bearing (16) on the fixed hinge (14) so as to be pivotable about a pivot axis (S), and wherein the biasable spring element (18) is arranged on the bearing (16) and is configured to be tensioned by an adjustable torque adjustment unit (28) having a central portion inserted in a center of the spring element, a toothed portion extending adjacent an outer perimeter of the spring element, and an arm portion extending radially between the central portion and the toothed portion, characterized in that the fixed hinge part (14) forms a housing (40) which accommodates the bearing (16), the spring element (18), and the torque adjustment unit (28) that is configured to be adjusted by an adjusting screw (30) located on the fixed hinge part (14) and meshing with the toothed portion of the adjustable torque adjustment unit, and a damping element (34).

2. The hinge (10) according to claim 1, characterized in that the flat spiral spring (18) and the pivot axis (S) are arranged coaxially.

3. The hinge (10) according to claim 1, characterized in that the flat spiral spring (18) has a radially outer end (26) connected to the pivotable hinge part (12).

4. The hinge (10) according to claim 1, characterized in that a portion of the pivotable hinge part (12) arranged on the bearing (16) is a plain bearing (23).

5. The hinge (10) according to claim 1, characterized in that a radially inner end (24) of the flat spiral spring (18) is operatively connected to the adjustable torque adjustment unit (28).

6. The hinge (10) according to claim 1, characterized in that the fixed hinge part (14) has an adjustable stop (36) for the pivotable hinge part (12).

7. The hinge (10) according to claim 2, characterized in that the flat spiral spring (18) has a radially outer end (26) connected to the pivotable hinge part (12).

8. The hinge (10) according to claim 2, characterized in that a portion of the pivotable hinge part (12) arranged on the bearing (16) is a plain bearing (23).

9. The hinge (10) according to claim 3, characterized in that a portion of the pivotable hinge part (12) arranged on the bearing (16) is a plain bearing (23).

10. The hinge (10) according to claim 2, characterized in that a radially inner end (24) of the flat spiral spring (18) is operatively connected to the adjustable torque adjustment unit (28).

11. The hinge (10) according to claim 3, characterized in that a radially inner end (24) of the flat spiral spring (18) is operatively connected to the adjustable torque adjustment unit (28).

12. The hinge (10) according to claim 4, characterized in that a radially inner end (24) of the flat spiral spring (18) is operatively connected to the adjustable torque adjustment unit (28).

13. The hinge (10) according to claim 8, characterized in that the fixed hinge part (14) has an adjustable stop (36) for the pivotable hinge part (12).

14. The hinge (10) according to claim 9, characterized in that the fixed hinge part (14) has an adjustable stop (36) for the pivotable hinge part (12).

15. The hinge (10) according to claim 4, characterized in that the fixed hinge part (14) has an adjustable stop (36) for the pivotable hinge part (12).

16. The hinge (10) according to claim 5, characterized in that the fixed hinge part (14) has an adjustable stop (36) for the pivotable hinge part (12).

17. The hinge (10) according to claim 13, characterized in that further arranged within the housing (40) is the plain bearing (23), as well as the adjustable stop in the housing (40).

18. The hinge (10) according to claim 14, characterized in that further arranged within the housing (40) is the plain bearing (23), as well as the adjustable stop in the housing (40).

19. The hinge (10) according to claim 15, characterized in that further arranged within the housing (40) is the plain bearing (23), as well as the adjustable stop in the housing (40).

* * * * *